US005456376A

United States Patent [19]

Luch et al.

[11] Patent Number: 5,456,376

[45] Date of Patent: Oct. 10, 1995

[54] SNAP-ON, SCREW OFF CAP AND CONTAINER NECK

[75] Inventors: Daniel Luch, Morgan Hill; Richard E. Repp, San Jose, both of Calif.

[73] Assignee: Portola Packaging, Inc., San Jose, Calif.

[21] Appl. No.: 29,177

[22] Filed: Mar. 10, 1993

Related U.S. Application Data

[63] Continuation-in-part of Ser. No. 830,133, Jan. 31, 1992, Pat. No. 5,267,661, which is a continuation-in-part of Ser. No. 772,945, Oct. 8, 1991, Pat. No. 5,213,229, which is a continuation-in-part of Ser. No. 565,638, Aug. 9, 1990, Pat. No. 5,190,178.

[51] Int. Cl.[6] ..... B65D 41/34

[52] U.S. Cl. ..... 215/256; 215/318; 215/320; 215/329; 215/354

[58] Field of Search ..... 215/252, 253, 215/254, 256, 307, 318, 320, 329, 330, 354, 356, 357, 341; 220/296, 361, 366, 203, 208

[56] References Cited

U.S. PATENT DOCUMENTS

| | | | |
|---|---|---|---|
| 1,630,687 | 5/1927 | Aulbach . | |
| 2,181,340 | 11/1939 | Plumb . | |
| 3,022,917 | 2/1962 | Montgomery . | |
| 3,223,269 | 12/1965 | Williams . | |
| 3,695,475 | 10/1972 | Ruekberg . | |
| 3,844,443 | 10/1974 | Cudzik . | |
| 3,874,540 | 4/1975 | Hidding . | |
| 3,902,621 | 9/1975 | Hidding . | |
| 3,980,195 | 9/1976 | Fillmore | 215/256 |
| 4,078,700 | 5/1978 | Hidding . | |
| 4,241,841 | 12/1980 | Boller . | |
| 4,298,129 | 11/1981 | Stull . | |
| 4,354,609 | 10/1982 | Hidding . | |
| 4,385,708 | 5/1983 | Curry . | |
| 4,402,415 | 9/1983 | Hopley . | |
| 4,448,319 | 5/1984 | Kern . | |
| 4,484,687 | 11/1984 | Bullock, III . | |
| 4,496,066 | 1/1985 | Bullock, III . | |
| 4,530,437 | 7/1985 | Gray et al. . | |
| 4,540,102 | 9/1985 | Wiedmer . | |
| 4,548,329 | 10/1985 | Curry . | |
| 4,561,553 | 12/1985 | Crisci . | |
| 4,625,875 | 12/1986 | Carr et al. . | |
| 4,700,860 | 10/1987 | Li . | |
| 4,739,891 | 4/1988 | Bullock, III . | |
| 4,744,478 | 5/1988 | Hahn . | |
| 4,796,770 | 1/1989 | Begley . | |
| 4,815,617 | 3/1989 | Collum . | |
| 4,828,128 | 5/1989 | Tackles . | |
| 4,844,250 | 7/1989 | Holoubek . | |
| 4,930,647 | 6/1990 | Dutt et al. | 215/252 |
| 4,934,546 | 6/1990 | Markley . | |
| 4,946,055 | 8/1990 | Towns et al. . | |
| 4,981,230 | 1/1991 | Marshall et al. . | |
| 4,989,740 | 2/1991 | Vercillo . | |
| 5,129,530 | 7/1992 | Fuchs . | |

FOREIGN PATENT DOCUMENTS

| | | |
|---|---|---|
| 812597 | 5/1969 | Canada . |
| 0118267 | 10/1986 | European Pat. Off. . |
| 2356007 | 5/1974 | Germany . |
| 1154369 | 3/1983 | Germany . |
| 2105693 | 3/1983 | United Kingdom . |
| 2114553 | 8/1983 | United Kingdom . |

*Primary Examiner*—Stephen P. Garbe
*Assistant Examiner*—Stephen Cronin
*Attorney, Agent, or Firm*—Julian Caplan; Janet E. Muller; Flehr, Hohbach, Test Albritton & Herbert

[57] ABSTRACT

A tamper-evident snap-on, screw-off closure is used with a specially shaped container neck. The neck has at least one first helical thread on an upper neck stretch portion, and a first tamper-evident structure having a first locking member. The closure has an upper skirt having at least one second helical thread mating with the first helical thread of the neck. The closure includes a second tamper-evident structure having a second locking member shaped and positioned to engage the first locking member when the closure is applied to the neck.

37 Claims, 4 Drawing Sheets

SNAP-ON, SCREW OFF CAP AND CONTAINER NECK

CROSS-REFERENCE TO RELATED APPLICATIONS

This application is a continuation-in-part of U.S. application Ser. No. 07/830,133 now U.S. Pat. No. 5,267,661, filed Jan. 31, 1992, which is a continuation-in-part of U.S. application Ser. No. 07/772,945 now U.S. Pat. No. 5,213,229, filed Oct. 8, 1991, which is a continuation-in-part of U.S. application Ser. No. 07/565,638 now U.S. Pat. No. 5,190,178, filed Aug. 9, 1990. The disclosures of the above-mentioned applications are hereby incorporated herein by reference.

BACKGROUND OF THE INVENTION

1. Field of the Invention

The present invention relates in general to a tamper-evident container closure and a container neck structure. More particularly, the present invention relates to a closure which is applied with an axial downward force onto the neck without relative rotation of the closure and container. After the tamper-evident feature of the invention is removed, the cap may be screwed onto and off the container as a reclosure cap.

2. Description of the Related Art

The snap-on, screw-off structures available in the prior art are of two general types-those having thread engagement as initially applied, and those without initial thread engagement. The no-thread initial engagement system has the major advantages of being simple to manufacture and apply, and achieving good re-seal on re, closure through the thread torque. However, using a liner closure with this system is somewhat difficult and the consumer may be confused by the requirement of twisting the closure relative to the neck after the container is initially opened by a lifting motion. Examples of closure systems having no-thread initial engagement are those taught by U.S. Pat. No. 4,561,553 to Crisci, and U.S. Pat. No. 4,946,055 to Towns et al.

Systems having partial to full thread engagement after the initial application have several advantages over the no-thread system, including the elimination of consumer confusion. However, the initial thread engagement systems often do not offer the manufacturing and application advantages available with the no-thread system. With some systems, the closure must be twisted relative to the container at some point during the application process. An example of such a closure is shown in U.S. Pat. No. 4,625,875 to Carr. Other concepts, such as that taught by Miskin in the European Patent Specification No. 0 118 267 do not require orientation or twisting during application, and accommodate for the inevitable closure height variation after application by employing an extended plug to seal against the inside bore of the container neck.

Both the system taught by Carr and Miskin suffer from the requirement that the tamper evident band must be expanded over a restrictive container bead during the application process. This requirement leads to application difficulties, especially in the Miskin concept where the rotary assist as taught by Carr is not employed. An additional problem common to both the Carr and Miskin concepts is that the lower tamper evident band is joined to the upper closure skirt through bridges requiring mold slides for formation, a feature which greatly increases the cost and complexity of injection molding tooling. Finally, in both the Miskin and Carr concepts the tamper evident band remains on the bottle after initial opening, a feature which thwarts effective container recycling.

Other systems available in the art include screw-on, screw-off structures which also offer the advantages of initial thread engagement and elimination of consumer confusion. An example of this type of closure is shown in U.S. Pat. No. 3,980,195 to Fillmore. The system taught by Fillmore includes a threaded, tamper-evident closure with a removable band. The interior of the removable band is formed with a one-way ratchet, which cooperates with projections formed on the neck to prevent unscrewing of the container. When the closure is initially twisted onto the neck, the ratchet teeth slip over the projections on the neck. The band must be removed prior to opening the container.

The snap-on, screw-off structures have several advantages not found with the closure taught by Fillmore. The application process used with the screw-on, screw-off systems is quite complex, since the cap must be turned or rotated relative to the container until the closure is fully seated. The frangible connections between the tamper-evident band and the closure must be sufficiently strong to prevent partial separation when the cap is twisted onto the container, increasing the costs of manufacture. The consumer will also often have difficulty removing the closure, since the band must first be separated from the rest of the cap.

This invention provides a snap-on, screw off system with partial or full thread initial engagement by reason of a unique thread design, a unique tamper-evident band and optional means for orienting the closure and container threads to achieve registration prior to straight axial application. The present invention offers considerable advantages over prior structures as is evident from the description of the related art and the following description of the invention.

SUMMARY OF INVENTION

The present invention comprises an improved closure or cap and an improved neck finish. The cap skin and neck are provided with mating threads of such shape that the cap may be applied in a simple downward vertical movement without relative rotation, the cap skirt flexing sufficiently to permit the threads to slip past each other.

The neck finish of the present invention includes a downward extending upper neck stretch portion having at least one helical thread formed on the neck exterior. The closure has a downward extending upper skirt portion depending from a top, the upper skirt portion being adapted to fit over the neck stretch portion. At least one helical thread is formed on the interior of the upper skirt portion, and is shaped to mate with the helical thread formed on the neck.

The closure of the present invention is applied to the neck in a direct, axial downward direction without relative rotation of the neck and the closure. The helical threads are shaped, and the closure is resilient, so that the threads will slip past each other and interengage when the closure is directly applied to the container. The interengagement of the threads requires that the closure be unscrewed for removal from the container. To provide evidence of tampering with the contents of the container, the neck includes a tamper-evident structure which cooperates with a tamper-evident structure on the closure. The tamper-evident structures each have locking members, which interengage when the closure seats on the neck to restrain unscrewing of the closure with the tamper-evident structures intact.

The closure may be formed having an orientation structure, such as a tear tab, for aligning the closure relative to the container. Similarly, the container may include an orientation structure, such as a non-circular cross section, for orienting the container with respect to the closure. The orientation features may be used to achieve complete thread engagement during straight axial application. This feature allows use of lined closures for extra seal security or reduction in seal plug and closure height.

In one aspect of the present invention, the locking member of the closure includes at least one tooth. The neck locking member comprises at least one tooth formed about the circumference of the neck. The tooth formed on the closure and the tooth formed on the neck are shaped and positioned to interengage when the closure is applied to the neck, thereby preventing unscrewing of the cap. To open the container, one of the tamper-evident structures must be removed, separating the interengaged teeth.

In a preferred modification, the tamper-evident structure is connected to the upper skirt portion by a frangible section, such as a plurality of radially spaced bridges. Alternatively, a line of weakness may be formed through the cap along the intersection between the tamper-evident structure and upper skirt portion. The tamper-evident structure is removed from the closure by fracturing the frangible section, disengaging the teeth and providing visible evidence of tampering.

When opening a container, if the consumer is not concentrating on the condition of the cap, he may not notice that the frangible section has been fractured, the cap having been previously removed from the container. Therefore, the preferred embodiment of the present invention further comprises means for removing the tamper-evident structure from the container, such as a tear tab and a line of weakness extending through the tamper-evident structure. The tear tab is preferably located adjacent this line of weakness. To remove the tamper-evident structure from the closure, the consumer pulls the tab, rupturing the line of weakness and the frangible section. Since the tamper-evident structure is at least partially removed from the closure, tampering with the contents of the container may be detected by even the inattentive consumer.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 7 is a fragmentary, bottom plan view of an another embodiment of a

DETAILED DESCRIPTION OF THE PREFERRED EMBODIMENTS

Figure 1:
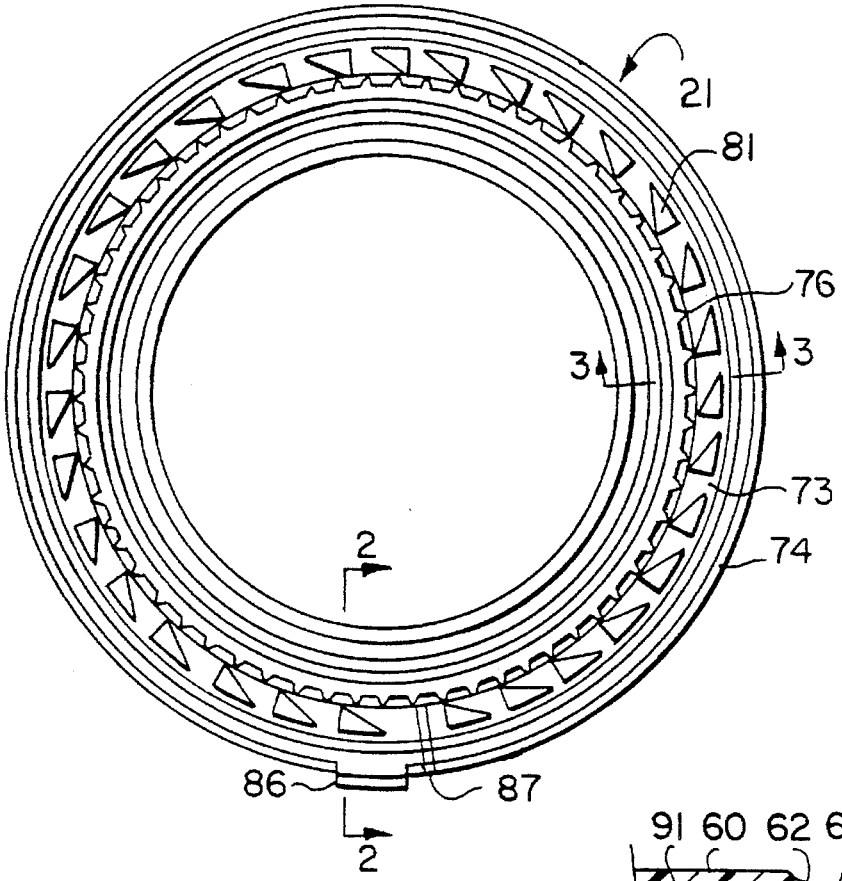
FIG. 1 is a bottom plan view of a cap.
Figure 2:
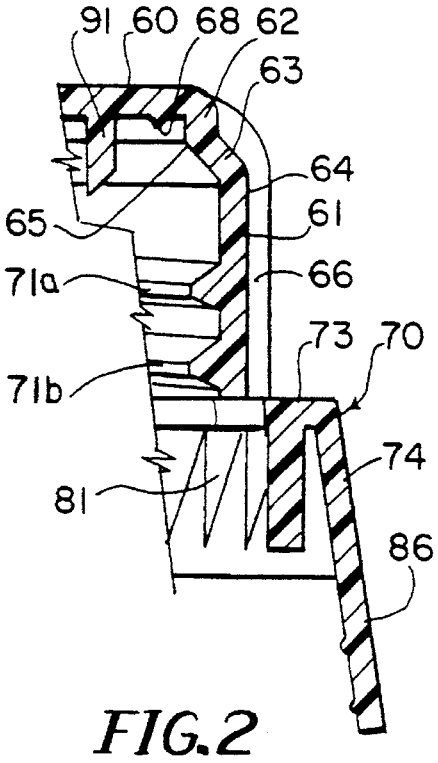
FIG. 2 is an enlarged, fragmentary sectional view of a cap taken along line 2—2 of FIG. 1.
Figure 3:
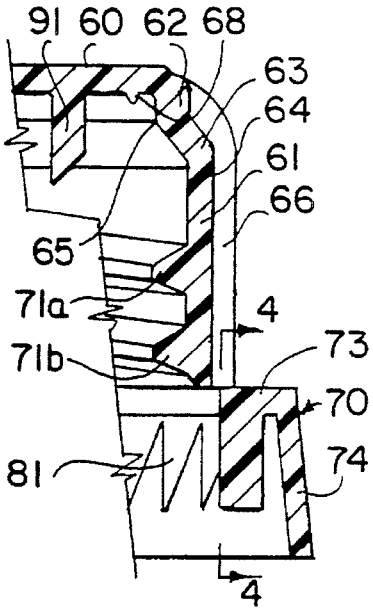
FIG. 3 is an enlarged, fragmentary sectional view of a cap taken along line 3—3 of FIG. 1.
Figure 4:
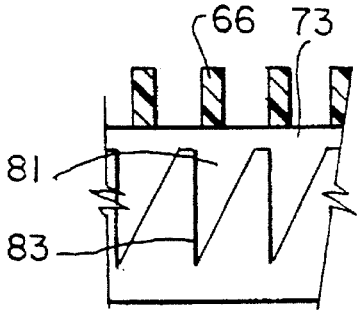
FIG. 4 is an enlarged, fragmentary sectional view taken along line 4-4 of FIG. 3.

Reference will now be made in detail to the preferred embodiments of the invention, examples of which are illustrated in the accompanying drawings, While the invention will be described in conjunction with the preferred embodiments, it will be understood that they are not intended to limit the invention to those embodiments, On the contrary, the invention is intended to cover alternatives, modifications and equivalents, which may be included within the spirit and scope of the invention as defined by the appended claims.

Closure 21, hereinafter described in detail, is used with a container neck 22. The interior of the neck forms no part of the present invention, With a blow-molded bottle finish, the interior contour tends to follow that of the neck exterior, However, it will be understood that other types of bottles may be used, with the internal shape of the neck varying from that of the exterior, Neck 22 has a central opening 23 and a downward-outward slanted lip flange 24 terminating in a vertical stretch 28. Threads 29 extend outward of stretch 28, In the illustrated embodiment, there are two threads **29*a* and 29*b*. The finish has twelve threads per inch with a double lead, each thread being six pitch and extending slightly in excess of 360° of a full thread. It is to be understood that the threads may be extended greater than 360° for increased thread engagement. Additionally, the thread leads may be of a different linear thread density (threads per inch). The upper flank 36 of thread 29 slants downwardly/outwardly at approximately 45° while the lower flank 37 slants downwardly/inwardly at approximately 10°, permitting the threads on the interior of the cap to slip past the threads on the neck finish, Preferably, the thread apex 38 is made with as large a radius as possible, but being sufficient to insure that the cap must be unscrewed and not pulled from the neck, Instead of cooperatively shaped threads on the upper neck stretch portion and the inner surface of the closure, one thread may be replaced by a groove. Further, threads 29** may be interrupted, instead of being continuous.

The container neck includes tamper-evident means, such as locking portion 40 below the vertical stretch and locking means here shown as upward projecting teeth 51. The locking portion has an outward extending shoulder portion 42 and a lower neck stretch portion 46 offset outwardly relative to the upper neck stretch portion. In the illustrated embodiment, the lower neck portion is vertical and terminates in shoulder stretch portion 47. A vertical stretch 48 depends from shoulder 47. To facilitate gripping the container during filling and loading, vertical stretch 48 may be formed with a number of bumper ring segments 49 (here shown as four in number).

Figure 6:
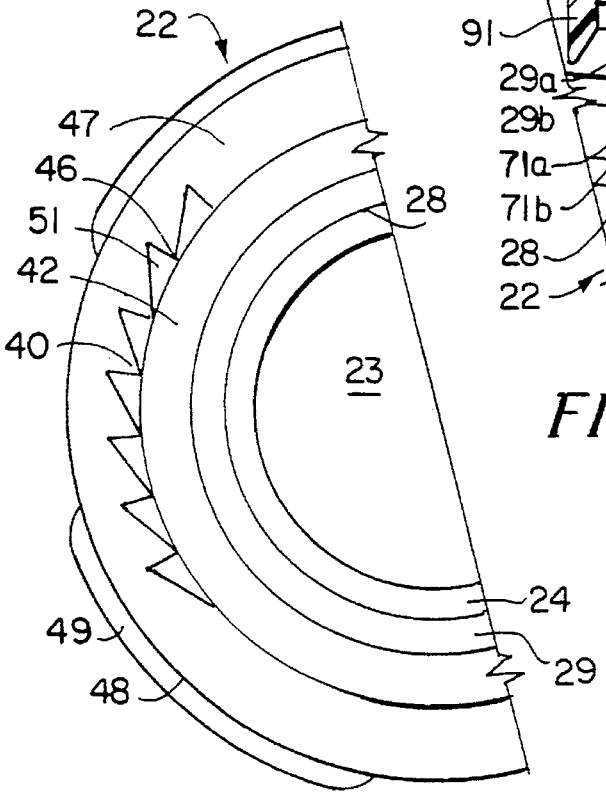
FIG. 6 is a fragmentary, top plan view of a container.

The locking means, or upward projecting teeth 51, are formed along shoulder stretch 47. The teeth are shaped and positioned to cooperate with internal teeth formed on the closure. Typically, multiple teeth 51 (FIG. 6) are formed on either side of neck 22, with the total extent of the multiple teeth being approximately 90°. The teeth 51 are shaped to interengage the internal ratchet teeth formed on the cap, preventing twisting of the cap relative to the neck. In the illustrated embodiments, teeth 51 are formed on shoulder stretch 47. However, in alternative forms of the present invention the teeth may be located on lower stretch 46, interengaging ratchet teeth formed on the interior of the cap.

Figure 5:
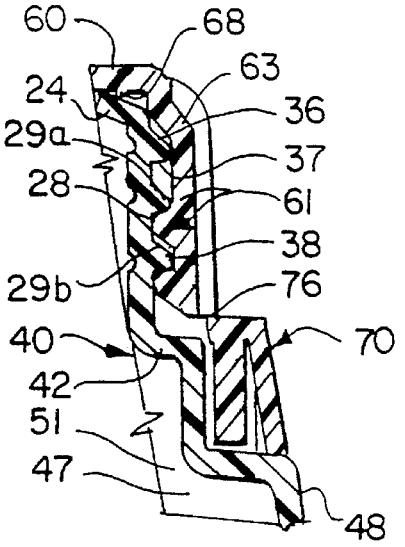
FIG. 5 is an enlarged, fragmentary sectional view of a cap applied to a neck.
Figure 5A:
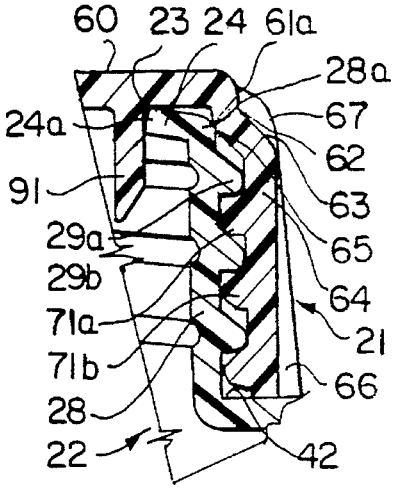
FIG. 5A is an enlarged, fragmentary sectional view of a cap applied to a neck.

A cap for use with neck structure 22 is illustrated in FIGS. 1 to 5. The cap has a top 60 from the periphery of which depends downward extending upper skirt 61. As illustrated, the top comprises a generally flat top disk; however, other configurations may be substituted. The upper skirt 61 is formed with a generally vertical upper edge 62 which merges with outward-downward slanted stretch 63, which in turn merges with vertical stretch 64. An internal shoulder 65 is formed at the intersection of stretches 62 and 63. A sealing bead 68 depends from the underside of top 60. When the cap 21 seats on the neck, bead 68 engages lip flange 24, internal shoulder 65 engages the upper edge of vertical stretch 28 and inner skirt 91 engages lip flange 24, substantially sealing the container. Members 62, 63 and 64 have radially spaced vertical ribs 66 to enable the user to grip the cap. As is shown in FIG. 5A, the internal shoulder 65 provides an inward projecting portion 61*a* of the upper skirt 61 which cooperates with the exterior of the neck stretch 28. Since the circumference of the upper portion 28*a* of neck stretch 28 is greater than the interior circumference of the cap 21 at the inward projecting portion 61*a* of the skirt, a tight fit is formed between the inward projecting portion and the neck stretch exterior. The tight fit between the upper skirt portion above thread 71*a* and the exterior of the neck stretch 28 above thread 29*a* promotes an effective seal between the exterior of the plug 91 and the interior edge 24*a* of the lip 24. When the cap 21 is applied to the neck 22, the tipper skirt 61 is biased outward as the inward projecting portion 65 engages the exterior of the neck stretch 28. Since the closure is resilient, the inner plug 91 of the cap is urged toward the lip 24 to form a seal between the generally seamless interior edge 24*a* of the lip and exterior of the plug 91. In other words, the inward projecting portion provides a means for biasing the upper skirt and the plug outward to urge the plug into sealing engagement with the lip 24. The fit of the shoulder against the neck tends to reduce leakage and rigidify the cap, preventing the cap from being turned or torqued to jump threads or strip the threads. The inner plug 91 of the cap 21 tends to push the neck of the bottle outward against the shoulder and the shoulder then prevents turning or stripping.

Threads 71*a* and 71*b*, which are selected to mate with threads 29 of neck 22, are formed on the interior of the skirt. The shape of threads 29*a*, 29*b*, 71*a* and 71*b* allow the threads to slip past one another and then interengage. Threads 71*a* and 71*b* are double lead and each extend around the circumference of the cap in excess of 180°, for example, approximately 200°. In conventional capping machines, cap 21 is deposited on neck 22. Since threads 71*a*, 71*b* are diametrically opposed, the cap tends to rest horizontally on neck 22, facilitating the application of the cap onto the neck with a downward, axial force.

In order for the closure and container threads to effectively slip past each other during direct axial application it is necessary that the threads be finer than would be appropriate for a threaded closure applied by conventional rotary application. As threads become finer, a greater amount of total thread engagement is often necessary to prevent excessive forward stripping on reapplication. For the present embodiment, which includes a linear density of twelve threads per inch and is formed with double leads, a thread engagement of approximately 200° for each of the two cap threads is satisfactory (i.e. 400° of total thread engagement). Finer threads such as sixteen or twenty threads per inch would require greater total thread engagement.

The closure has tamper-evident means, for example a downward extending tamper-evident portion 70 below upper skirt portion 61 and locking means, such as internal ratchet teeth 81. In the present embodiment, the tamper-evident portion or lower band 70 comprises an annular shoulder 73 below the upper skirt 61, and a lower skirt portion 74 extending downward from the annular shoulder. A frangible section including a number of radially spaced bridges 76 interconnects the shoulder 73 and the upper skirt portion. The lower edges of ribs 66 form the bridges, frangibly connecting the lower band 70 to the upper skirt 61. Alternatively, a line of weakness may be formed through the intersection of shoulder 73 and upper skirt 61. In the illustrated embodiment the lower band is formed having two sections, with the lower skirt oriented at an angle relative to the annular shoulder. In a modified embodiment, discussed in relation to FIG. 12, the lower band may comprise a single, curved section which extends generally outward and downward from the upper skirt portion. The tamper-evident portion may additionally take many other forms.

In the present embodiment, a number of internal ratchet teeth 81 spaced and dimensioned to cooperate with the teeth 51 of neck 22 are formed on shoulder 73 spaced inwardly of lower skirt 74. The generally downward depending teeth 81 are positioned to engage teeth 51 when cap 21 is pushed onto neck 22. As is shown in FIG. 1, cap 21 includes multiple teeth 81 depending from shoulder 73. Teeth 81 include a generally inclined leading edge 83 for facilitating the application of the cap to neck 22. As the closure moves downward on the neck, leading edge 83 slides along tooth 51, the leading edge thereby guiding tooth 81 to a position between adjacent ones of teeth 51. The downward depending tooth 81 is retained between the teeth 51, interengaging the upward projecting teeth 51 to prevent twisting of the closure, thereby securing cap 21 on the neck. Teeth 81 are located on the shoulder in the present embodiment; however, the teeth may alternatively be positioned at other locations on the tamper-evident portion, such as along the inner surface of lower skirt portion 74.

The interlocking engagement between the teeth on the cap with those on the neck prevents twisting of the cap relative to the container while the tamper-evident means or lower band portion 70 is intact. To remove the closure from the neck, in the illustrated embodiment lower band 70 must be removed from upper skirt 61, disengaging teeth 81 from between teeth 51. The lower band is separated from the upper skirt 61 by rupturing the bridges 76 spaced along the frangible section. The ruptured bridges warn the consumer that the container has been opened and the contents tampered with.

A tear tab 86 is connected to the lower edge of lower band 70. In the present embodiment, the tear tab provides means for removing the lower band and may additionally be used to orient cap 21 relative to the container prior to application, if desired. Lower band 70 is formed with a line of weakness adjacent tab 86, generally indicated by 87, extending through lower skirt 74 and shoulder 73. The line of weakness facilitates removal of the lower skirt from the closure, and is another tamper-evident feature of the present invention. When initially opening the container, the consumer pulls tab 86 to remove lower band 70, rupturing line 87 and frangible section 76. The absence of the lower skirt more dramatically alerts the consumer to possible tampering with the contents. An inattentive consumer may fail to notice the fractured bridges, therefore the removal of the lower skirt is a more obvious indication of tampering. In the preferred form, completely removing lower band 70 from upper skirt 61 aesthetically enhances the appearance of cap 21, which is used to reseal the container. However, in other forms of the present invention the lower band may be only partially removed from the upper skirt portion for separating teeth 51 from teeth 81 to unscrew the cap from the container.

When a consumer desires to initially open the container, he grips tab 86 and pulls circumferentially around the container detaching lower band 70 from upper skirt 61. Ratchet teeth 81 are thereby removed from interlocking engagement with upward projecting teeth 51, providing evidence of tampering and enabling the consumer to unscrew cap 21 from neck 22. To replace the cap, the consumer merely reverses the direction of twisting.

Figure 8:
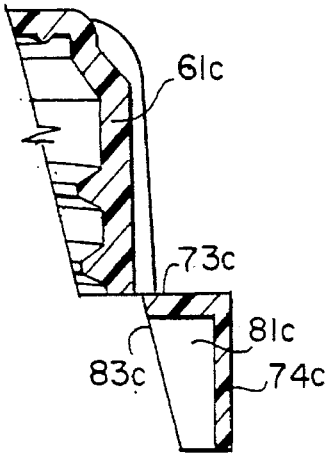
FIG. 8 is an enlarged, fragmentary sectional view taken along line 8—8 of FIG. 7.
Figure 7:
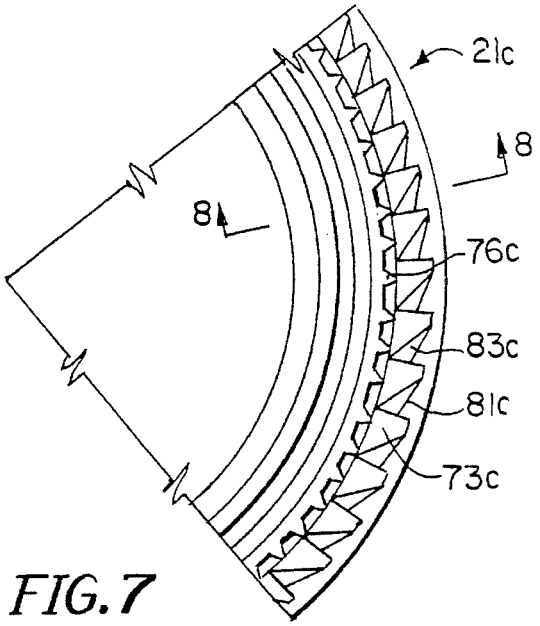

A modification of the cap is shown in FIGS. 7 and 8. The modified cap may be applied to a container having a neck configuration similar to that shown in FIG. 6. Several elements, which are substantially similar to those of the previously described embodiment, are identified by the original reference numeral and "c". In this embodiment, the tamper-evident means of cap 21*c* is provided by lower skirt 74*c* and locking means, such as a number of downward depending teeth 81*c*. The shoulder 73*c* extends horizontally outward from the lower edge of upper skirt portion 61*c*. A frangible section composed of a plurality of circumferentially spaced bridges 76c connects shoulder 73*c* to the lower edge of upper skirt 61*c*. The teeth 81*c* are dimensioned and positioned to engage the upwardly extending teeth 51 formed on the neck. To facilitate application of cap 21*c*, teeth 81*c* include a beveled inner edge 83*c*. When pushing the closure onto the neck, inner edge 83*c* directs the teeth 81*c* into interengagement with teeth 51.

Teeth 81*c* and teeth 51 cooperate to restrain unscrewing of cap 21*c* relative to the neck while the lower skirt remains intact. To unscrew the cap, lower skirt 74*c* is removed from upper skirt portion 61*c* by rupturing frangible bridges 76*c*. The modified cap may include a tear tab and a line of weakness extending through the lower skirt, as described with reference to the previously discussed embodiment for facilitating removal of tamper-evident skirt 74*c*. Alternatively, cap 21*c* may be twisted, fracturing the bridges, and unscrewed from the container with lower skirt 74*c* remaining around neck 22. The use of a tear tab and line of weakness is preferred, as it provides a clearer and more obvious indication of tampering, facilitates recycling of the container and substantially eliminates risk of injury to wildlife.

Figure 9:
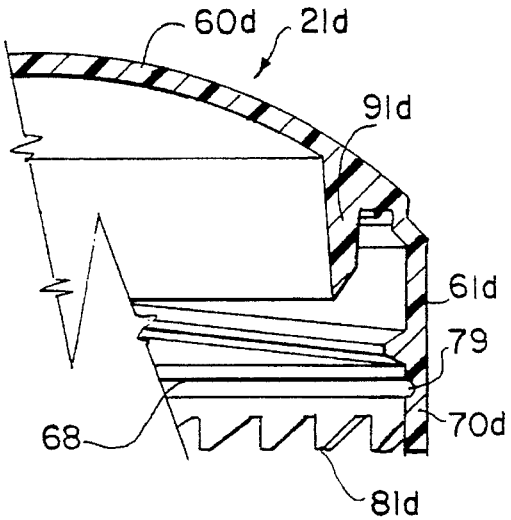
FIG. 9 is an enlarged, fragmentary side elevational view of an alternative embodiment of a cap, shown partly in cross section.
Figure 10:
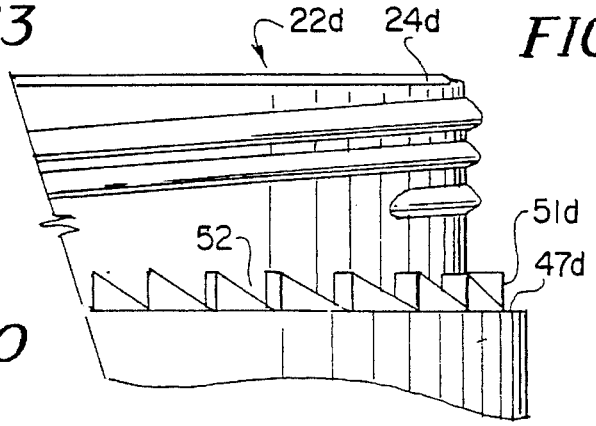
FIG. 10 is an enlarged, fragmentary side elevational view of an alternative embodiment of a neck.
Figure 11:
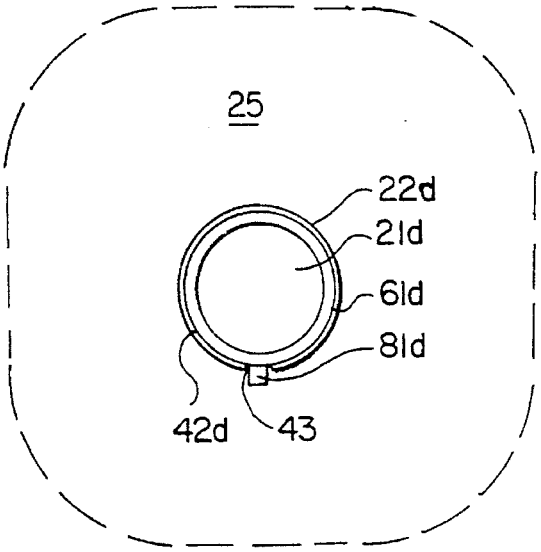
FIG. 11 is a fragmentary, top plan view showing the cap applied to a container.

An alternative modification of the cap and neck of the present invention is shown in FIGS. 9 to 11. Elements of the cap and neck which are similar to those in the previously described embodiments are designated by the reference numeral and "d". In the modified form, neck 22*d* is formed with several teeth 51*d* circumferentially spaced along shoulder stretch 47*d*. A pair of adjacent teeth 51*d* are separated by a space, generally designated 52, formed for receiving the teeth of the closure. When the closure is applied to the neck, a tooth formed on the closure is positioned within space 52 between the adjacent teeth 51*d*, thereby preventing rotation of the closure relative to the neck.

Cap 21*d* (FIG. 9) includes a domed top 60*d* having an inner skin 91*d* depending from the underside of the domed top. Inner skirt 91*d* engages lip flange 24*d* when the cap seats on the neck, forming an internal seal between the cap and the neck. In this embodiment, the lower band portion 70*d* comprises a number of teeth 81*d* generally depending from lower edge 68 of upper skirt 61*d*. The tamper-evident means are provided by the teeth 81*d*. The teeth 81*d* are shaped and positioned for interengaging teeth 51*d*, with one tooth 81*d* slipping into space 52 as the cap 21*d* is applied to neck 22*d*. The interengagement between teeth 51*d* and teeth 81*d* substantially restricts twisting of the closure relative to the neck, preventing unscrewing of the cap with the tamper-evident structure intact.

To remove cap 21*d* from neck 22*d*, the downward depending teeth 81*d* must be severed from upper skirt portion 61*d*. As is shown in FIG. 9, the upper skirt portion includes a line of weakness 79 extending about the circumference of the closure skirt. To remove the cap, the skirt portion below the line of weakness is torn away, facilitating unscrewing of the closure. Removal of the lower portion 70*d* is facilitated by a tear tab which is gripped while initiating a continuing tearing away of the lower skirt portion. As is shown in FIG. 11, one of the downward extending teeth 81*d* may be extended to provide a tear tab. When the cap is applied to the neck, one of the teeth 81*d* is deformed outward by depressed section 43 of shoulder stretch 47*d*. The consumer grips the outwardly deformed tooth 81*d* and removes the lower band portion 70*d* to separate the interengaged teeth 51*d* and 81*d* and open the container.

Figure 12:
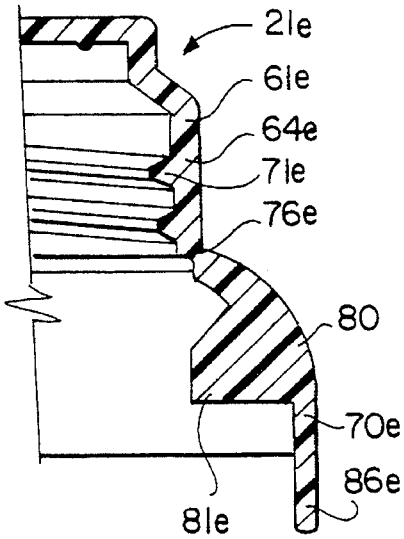
FIG. 12 is an enlarged, fragmentary side elevational view of another embodiment of a cap.

Another modification of a cap of the present invention is shown in FIG. 12. Elements of the cap similar to those in the previously described embodiments are designated by the reference numeral and "e". The cap 21*e* may be used with a neck of the type shown in FIG. 6. The cap 21*e* includes an upper skirt 61*e* having a generally vertical portion 64*e* and a lower band portion 70*e*. The lower band 70*e* extends generally outward and downward from the lower edge of vertical portion 64*e*, and is formed with a curved section 80. A number of internal teeth 81*e* are formed on the interior of the curved section 80 of the lower band. A frangible section, provided in the present embodiment by a line of weakness 76*e*, joins the lower band 70*e* to the upper skirt portion 61*e*. A tear tab 86*e* depends from the lower band 70*e*. When the cap 21*e* is applied to the neck 22, threads 71*e* slip past and interengage threads 29. Curved section 80 slips over outward extending shoulder 42 and lower neck portion 46, with the teeth 81*e* being shaped and positioned to interengage teeth 51. As with the previously described modifications, to open the container the consumer pulls tab 86*e*, fractures the line of weakness 76*e* and separates the lower band from the upper skirt, disengaging teeth 81*e* from teeth 51.

Figure 13:
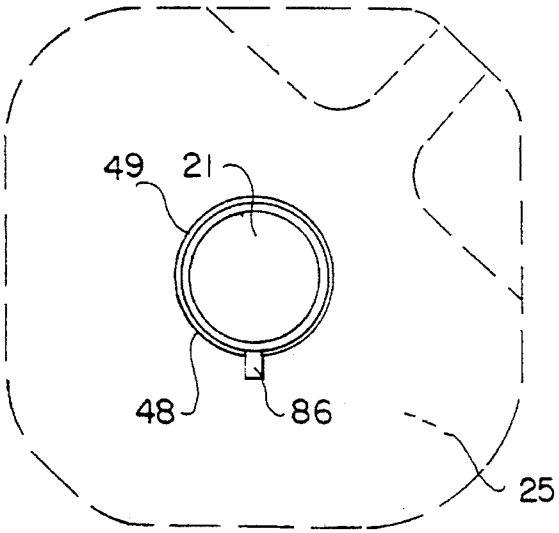
FIG. 13 is a top plan view of a cap applied to a container.

Turning to FIG. 13, cap 21 is shown seated on container 25. With the present invention, the closure may be conveniently oriented relative to the container prior to applying the closure to the neck. The tab 86 and the non-circular cross section are directed by the capping machine during the capping process to align the cap and container relative to one another, positioning teeth 51 and 81 for interengagement. When fully applied, the interengagement between the teeth 51 and 81 will prevent unscrewing of the cap. By first orienting the cap, full thread engagement may be achieved once the cap is pushed onto the neck. The locking means, such as teeth 51 and 81, are similarly fully interengaged to prevent removal of the closure with the tamper-evident portion intact.

In many instances, full thread engagement or complete interengagement of the teeth 51 and 81 is not necessary to securely retain the cap on the container. Additionally, the cap construction of the previous embodiments fosters substantial seating of the cap without prior orientation. For example, the locking means of the closure and neck are cooperatively shaped to slip past one another, thereby guiding the teeth 81 formed on the closure into interengagement with the teeth 51 formed on the neck. Thus, the various features of the present invention are not to be restricted to a snap-on, screw-off closure system in which the cap and container are first oriented relative to one another.

PREFERRED OPERATION

Figure 15:
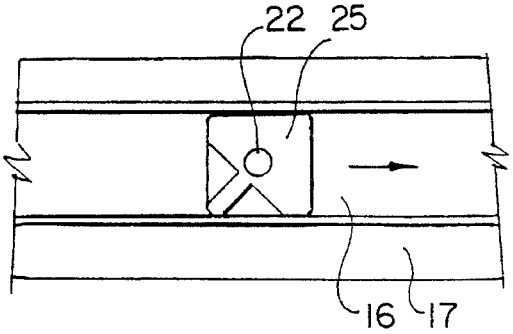
FIG. 15 is a partial top plan view of a capping machine, showing a container positioned on the conveyor belt.
Figure 14:
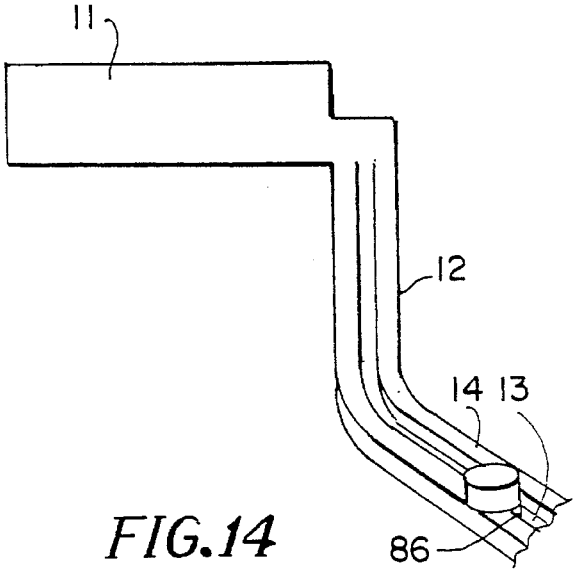
FIG. 14 is a fragmentary plan view of a capping machine, showing a cap positioned within the chute.

After the container has been filled, it is transported through a capping machine. The structure of capping machines is well known in the bottling art. As is well understood in the art, and in a manner similar to that whereby push-on, pull-off caps are applied, caps 21 are fed one at a time out of a bowl 11 in the capping machine along a chute 12 (FIG. 14). One type of chute 12 is formed with a space 13 between parallel rails 14, with tear tab 86 orienting the caps for uniform discharge in a pre-determined orientation relative to the containers passing therebelow by fitting into the space 13 between the rails 14. Each container 25 has a non-circular cross section or some other variation from a round shape, such as the rectangular shape shown in FIG. 13, which permits the container to be oriented relative to cap 21. The container 25 travels along a conveyer belt 16 below the capping machine (FIG. 15). Guide rails 17 adjacent the conveyor belt 16 directionally align the non-circular cross section of the container 25 relative to the tear tab 86 of the cap. Thus, in this present embodiment, the cap 21 and neck 22 may be conveniently oriented relative to one another by the conventional capping machine and conveyor belt system. Because of the relative orientation, threads 29 and 71 are in vertical alignment, ensuring full thread engagement and complete interengagement of the teeth 51 and 81. In other embodiments, the teeth 51 and 81 need not be vertically aligned.

An axially downward force is applied to the cap, pushing the cap onto the neck without externally imposed relative rotation of the cap and container. Threads 71*a* and 71*b* slip over threads 29*a* and 29*b*, the slanted surfaces 36 facilitating such movement. The cap is sufficiently resilient so that it expands outward to permit the threads to slip. As cap 21 seats on the neck, teeth 81 fall behind teeth 51, providing interengagement between teeth 51 and teeth 81. After the cap has been fully seated on neck 22, it may not be removed without providing evidence of tampering. The interengagement between teeth 51 and 81 prevent unscrewing of the cap from the container, while the interengagement between the threads prevents lifting of cap 21 off neck 22.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a container having a neck and a container closure, said neck having an upper opening, a downward extending neck stretch below said opening, said neck stretch having an exterior, at least one first helical engagement means formed around said exterior of said neck stretch, and first tamper-evidencing means on said neck, said closure having a top, a downward extending upper skirt portion depending from said top adapted to fit over said neck stretch, said upper skirt portion having an interior, at least one second helical engagement means formed around said interior of said upper skirt portion shaped to mate with said at least one first helical engagement means, and second tamper-evidencing means, said at least one first and second helical engagement means being shaped and said closure being resilient so that upon application of force to accomplish direct, axial movement of said closure relative to said container without externally imposed relative rotation of said closure and said neck, said at least one first and second helical engagement means slip past each other and then interengage and said closure seats on said neck so that said closure cannot be removed from said neck without unscrewing said closure, one of said first and second tamper-evidencing means being frangible, said first tamper-evidencing means having first locking means, said second tamper-evidencing means having a lower band portion below said upper skirt portion and second locking means, said first and second locking means being shaped and positioned to interengage once said closure is seated on said neck upon said direct axial movement, said second locking means including at least one internal tooth formed on said lower band portion, said at least one internal tooth being shaped and positioned to cooperate with said first locking means to restrain unscrewing of said closure with said first and second tamper-evidencing means intact, said at least one internal tooth having a beveled inner surface extending downwardly and outwardly toward a lower edge of said lower band portion for directing said at least one internal tooth into interengagement with said first locking means.

2. The combination of claim 1 wherein, said first tamper-evidencing means includes a locking portion below said neck stretch, and said first locking means includes at least one external tooth projecting outwardly from said locking portion.

3. The combination of claim 1 wherein, said first tamper-evidencing means includes a shoulder extending outwardly from said neck stretch, and said first locking means includes at least one upwardly extending tooth projecting from said shoulder.

4. The combination of claim 1 wherein, said lower band portion defines a circle and said inner surface of said at least one internal tooth extends outwardly in a direction parallel to a secant of said circle.

5. The combination of claim 1 wherein, said upper skirt portion includes a lower edge, said lower band portion includes a shoulder extending outwardly from said lower edge and a lower skirt portion depending from said shoulder, said shoulder having an underside, and said at least one internal tooth depends from said underside of said shoulder.

6. The combination of claim 5 wherein, said lower skirt portion has an inside, and said at least one internal tooth is spaced inwardly from said inside of said lower skirt portion.

7. The combination of claim 5 wherein, said inner surface of said at least one internal tooth extends downwardly and outwardly from said underside of said shoulder.

8. The combination of claim 1 wherein, said upper skirt portion includes a lower edge, said lower band portion is formed with a curved section extending generally outward and downward from said lower edge, said curved section having an inside, and said at least one internal tooth is formed on said inside of said curved section.

9. The combination of claim 1 wherein, said upper skin portion has a lower edge, and said second tamper-evident means includes at least one tooth projecting downward from said lower edge, said at least one downward depending tooth and said first tamper-evident means being shaped and positioned to interengage when said closure is seated on said neck.

10. The combination of claim 1, and frangible means connecting said second tamper-evidencing means to said upper skirt portion.

11. The combination of claim 1, and first orientation means on said container, second orientation means on said closure, said first and second orientation means being positioned to be directionally engaged by respective first and second external orientation means to orient said closure relative to said container so that, upon application of said force to accomplish said direct axial movement of said closure relative to said container without externally imposed rotation of said closure relative to said neck, said first and second locking means interengage to prevent unscrewing of said closure from said neck so long as said first and second tamper-evidencing means are intact.

12. The combination of claim 11 wherein, said first orientation means comprises at least a portion of said container having a substantially non-circular cross section, said non-circular cross section being shaped and positioned to be engaged by external orientation means for aligning said container relative to said closure.

13. The combination of claim 11 wherein, said second orientation means comprises a tab projecting from said closure, said tab being shaped and positioned to be engaged by external orientation means for aligning said closure relative to said container.

14. The combination of claim 1 wherein, said at least one first and second helical engagement means are screw threads, said at least one first and second helical engagement means having at least twelve threads per inch.

15. The combination of claim 1, and means for removing one of said first and second tamper-evidencing means.

16. The combination of claim 1 wherein, said top has an underside, and said closure is formed with an internal shoulder at the intersection of said underside of said top and said interior of said upper skirt portion, said internal shoulder engaging said neck stretch when said closure seats on said neck.

17. The combination of claim 1, and a plurality of external ribs formed on an exterior surface of said upper skirt portion.

18. A container closure for use with a container having a neck of the type having an upper opening, a downward extending neck stretch portion below said opening, said neck stretch portion having an exterior, at least one first helical engagement means formed around said exterior of said neck stretch portion, and first tamper-evidencing means below said neck stretch portion, said first tamper-evidencing means having first locking means, said closure having a top, a downward extending upper skirt portion depending from said top adapted to fit over said neck stretch portion, said upper skirt portion having an interior, at least one second helical engagement means formed around said interior of said upper skirt portion shaped to mate with said at least one first helical engagement means, and second-tamper evident means, said closure being resilient and said at least one second helical engagement means being shaped to slip past and then interengage with said at least one first helical engagement means when said closure is moved in a direct, axial direction relative to said container without externally imposed relative rotation of said closure and said neck to seat said closure on said neck so that said closure cannot be removed from said neck without unscrewing said closure, said second tamper-evidencing means being frangible, said second tamper-evidencing means having a lower band portion and second locking means, said second locking means being shaped and positioned to interengage said first locking means once said closure is seated on said neck upon direct axial movement of said closure relative to said neck, said second locking means including at least one internal tooth formed on said lower band portion, said at least one internal tooth being shaped and positioned to cooperate with said first locking means when said closure is seated on said neck to restrain unscrewing of said closure with said second tamper-evidencing means intact, said at least one internal tooth having a beveled inner surface extending downwardly and outwardly toward a lower edge of said lower band portion for directing said at least one internal tooth into interengagement with said first locking means upon said direct axial movement of said closure relative to said neck.

19. The closure of claim 18 wherein, said lower band portion defines a circle and said inner surface of said at least one internal tooth extends outwardly in a direction parallel to a secant of said circle.

20. The closure of claim 18 wherein, said lower band portion is formed with a curved section extending generally outward and downward from said upper skirt portion, and said at least one internal tooth is formed on said curved section of said lower band portion.

21. The closure of claim 18 wherein, said upper skirt portion has a lower edge, said lower band portion includes a downward extending lower skirt portion having an upper edge and a shoulder extending inwardly from said upper edge of said lower skirt portion to said lower edge of said upper skirt portion, said shoulder having an underside, and said at least one internal tooth depends from said underside of said shoulder.

22. The closure of claim 21 wherein, said lower skirt portion has an inside, and said at least one internal tooth is spaced inwardly relative to said inside of said lower skirt portion.

23. The closure of claim 21 wherein, said inner surface of said at least one internal tooth extends downwardly and outwardly from said underside of said shoulder.

24. The closure of claim 18 wherein, said second tamper-evident means comprises a downward extension of said upper skirt portion, said downward extension being shaped and positioned for engagement by said first locking means to restrain unscrewing of said closure with said first tamper-evident means and said second tamper-evident means intact.

25. The closure of claim 24 wherein, said downward extension comprises at least one downward extending tooth.

26. The closure of claim 18, and frangible means connecting said second tamper-evidencing means to said upper skin portion.

27. The closure of claim 26 wherein, said frangible means comprises a plurality of spaced bridges.

28. The closure of claim 26 wherein, said frangible means comprises a line of weakness extending between said upper skirt portion and said second tamper-evidencing means.

29. The closure of claim 18, and orientation means on said closure, said orientation means being shaped and positioned to be directionally engaged for orienting said closure relative to said container so that, upon application of a force to accomplish said direct axial movement of said closure relative to said container without externally imposed relative rotation of said closure and said neck, said second locking means interengages with said first locking means to prevent unscrewing of said closure from said neck without removing said second tamper-evidencing means from said closure.

30. A container closure for use with a container having a neck of the type having an upper opening, a downward extending neck stretch below said opening, said neck stretch having an exterior, at least one first helical engagement means formed around said exterior of said neck stretch, and first tamper-evidencing means on said neck, said first tamper-evidencing means having at least one upward projecting tooth, said closure having a top, a downward extending upper skirt portion depending from said top adapted to fit over said neck stretch, said upper skirt portion having an interior, at least one second helical engagement means formed around said interior of said upper skirt portion shaped to mate with said at least one first helical engagement means, and second tamper-evidencing means, said at least one second helical engagement means being shaped and said closure being resilient so that, upon application of force to accomplish direct, axial movement of said closure relative to said container without externally imposed relative rotation of said closure and said neck, said at least one second helical engagement means slips past and then interengages said at least one first helical engagement means and said closure seats on said neck so that said closure cannot be removed from said neck without unscrewing said closure, said second tamper-evidencing means being frangible, said second tamper-evidencing means having at least one downward depending tooth shaped and positioned to interengage said at least one upward extending tooth upon axial movement of said closure onto said neck to thereby prevent unscrewing of said closure relative to said neck without removal of said second tamper-evidencing means from said closure, said at least one downward depending tooth having a downward outward slanted inner surface for directing said at least one downward depending tooth into interengagement with said at least one upward projecting tooth.

31. The closure of claim 30 wherein, said upper skirt portion defines a circle and said inner surface of said at least one downward depending tooth extends outwardly in a direction parallel to a secant of said circle.

32. The closure of claim 30 wherein, said second tamper-evidencing means includes a lower band portion including a shoulder having an underside and an outer skirt portion depending from said shoulder having a lower edge, said inner surface of said at least one downward depending tooth extends downwardly and outwardly from said underside of said shoulder.

33. In combination, the closure of claim 30 and a container having a neck of the type having an upper opening, a downward extending neck stretch below said opening, said neck stretch having an exterior, at least one first helical engagement means formed around said exterior of said neck stretch shaped to mate with said at least one second helical engagement means, and first tamper-evidencing means on said neck, said first tamper-evidencing means having at least one upward projecting tooth shaped and positioned to engage said at least one downward depending tooth.

34. The closure of claim 30 wherein, said upper skirt portion has a lower edge, and said second tamper-evident means extends downwardly from said lower edge.

35. The closure of claim 34 wherein, said second tamper-evident means includes a plurality of downward depending teeth circumferentially spaced around said second tamper-evident means.

36. The closure of claim 30 wherein, said second tamper-evident means includes a lower band portion having a shoulder extending from said upper skirt portion and a lower skirt portion depending from said shoulder, said shoulder having an underside, and said at least one downward depending tooth is formed on said underside of said shoulder, said at least one downward depending tooth being spaced inwardly from said lower skirt portion.

37. The closure of claim 30, and frangible means joining said second tamper-evidencing means to said upper skirt portion.

* * * * *